United States Patent [19]

Morishita

[11] 4,179,077

[45] Dec. 18, 1979

[54] DEVICE FOR LOADING A PAPER ROLL

[75] Inventor: Taneji Morishita, Hino, Japan

[73] Assignee: Konishiroku Photo Industry Co., Ltd., Tokyo, Japan

[21] Appl. No.: 896,239

[22] Filed: Apr. 14, 1978

[30] Foreign Application Priority Data

Apr. 21, 1977 [JP] Japan ..... 52-49528

[51] Int. Cl.[2] ..... B65H 23/08; B65H 19/10

[52] U.S. Cl. ..... 242/55; 242/55.2; 242/58; 242/68; 242/75.4

[58] Field of Search ..... 242/55.2, 55.53, 55.3, 242/55.42, 55.54, 75.4, 129.6, 129.8, 156, 58, 156.1, 156.2, 68, 55

[56] References Cited

U.S. PATENT DOCUMENTS

| | | | |
|---|---|---|---|
| 1,156,266 | 10/1915 | Bens et al. | 242/55.2 |
| 1,705,514 | 3/1929 | Widenmann et al. | 242/75.4 |
| 1,858,371 | 5/1932 | Lutz | 242/55.2 |
| 1,928,106 | 9/1933 | Koch et al. | 242/55.53 X |
| 2,036,035 | 3/1936 | Giallanza | 242/129.6 |
| 2,411,293 | 11/1946 | Roehner | 242/55.2 |
| 2,517,809 | 8/1950 | Tarzian | 242/55.2 |
| 2,747,807 | 5/1956 | Hummel | 242/75.4 X |

*Primary Examiner*—George F. Mautz

*Attorney, Agent, or Firm*—Limbach, Limbach & Sutton

[57] ABSTRACT

An improved paper roll loading device is disclosed which includes a center shaft adapted to be fitted into the center hole of a paper roll and pivotally supported with a first support member, a second support member for supporting the other end of said center shaft, and means for pressing the end face of the paper roll fitted to the center shaft in a direction apart from the second support member when the said the other end of the center shaft is supported with the second support member.

5 Claims, 6 Drawing Figures

DEVICE FOR LOADING A PAPER ROLL

BACKGROUND OF THE INVENTION

The present invention relates to a paper roll loading device for use in a copying machine, facsimile equipment, recording instrument, teletypewriter, computer input/output printer or the like.

The conventional paper roll loading devices of this type known heretofore are such as shown in FIGS. 1 through 3. In the example of FIG. 1, a center shaft 1 to be fitted into the center hole of a recording paper roll and a stationary support member 2 are formed individually to be separate from each other, wherein the center shaft 1 disengaged from a recess 11 of the stationary support member 2 is fitted into the center hole of recording paper roll 12 and then is set in the recess 11 of stationary support member 2. In this device, although alignment of the center line is easily attained, it is liable to cause loss of the center shaft due to the structure that the center shaft and the stationary support member are separate in composition. Further the operation of fitting the center shaft into the recording paper roll or setting the same in the stationary support member can hardly be performed by a single hand without trouble. And there exists further disadvantage that the paper roll is permitted to freely rotate since it is held merely by the center shaft alone, so that the roll may undesirably loose during use.

In the example of FIG. 2, each of support members 14 is composed of an elastic material, and a stationary boss 13 is attached thereto. And when loading paper roll 12, it is necessary to align the center hole of the paper roll with the stationary bosses while widening the space between the elastic support members 14 by hand. This device is disadvantageous in the points that, in addition to a troublesome paper loading operation, aligning the center line is difficult.

And in the device of FIG. 3, a spring 15 and a stationary boss 13 with an adjuster 16 are attached to a stationary support member 2 in such a manner that the stationary boss 13 is fittable into the center hole of recording paper roll 12. And when loading the paper roll, first the space between the stationary bosses is widened by the adjuster 16, and then the paper roll is inserted in the space with its center hole being aligned with the stationary bosses. According to this device, there are also some problems including inconvenient loading operation and difficult alignment of the center line.

As is clear from the above, demerits are concomitant with merits in each of the conventional devices wherein looseness of the paper roll occurs during use if alignment of the center line is easily attainable, or loading the paper roll becomes troublesome and aligning the center line is difficult if the occurrence of loosening of the roll is prevented. Thus, there is not such a satisfactory device available today that is capable of effecting easy loading of the paper roll and easy alignment of the center line without loosening of the paper roll during use.

SUMMARY OF THE INVENTION

In accordance with the present invention, there is provided an improved paper roll loading device which includes a center shaft adapted to be fitted into the center hole of a paper roll and pivotally supported to a first support member at one end, a second support member for supporting the other end of the center shaft.

Preferably, the device further includes means for preventing the undesirable movement of the paper roll, for example means for pressing the end face of the paper roll fitted to the center shaft in a direction apart from the second support member when the other end of the center shaft is supported with the second support member.

It is an object of the present invention to provide a paper roll loading device which facilitates single-handed space loading of the paper roll and executes immediate alignment of the center line.

Another object of the present invention is to provide a paper roll loading device in which the paper roll is allowed to be held at a fixed position and the occurrence of loosening of the paper roll during the use is prevented.

Other objects, advantages and features of the present invention will become apparent from the detailed description of the preferred embodiments which follows, when considered in light of the accompanying drawings.

DESCRIPTION OF THE PREFERRED EMBODIMENT

Figure 1:
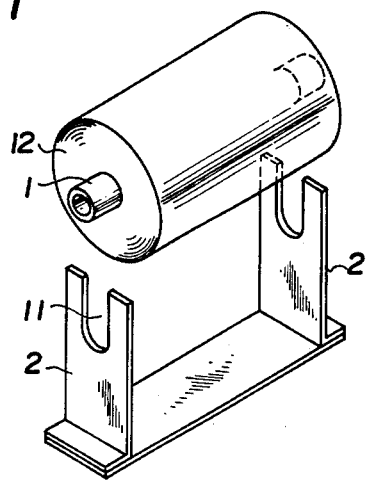
FIG. 1 PRIOR ART
FIG. 1 is a perspective view illustrating an example of a conventional paper roll loading device.
Figure 2:
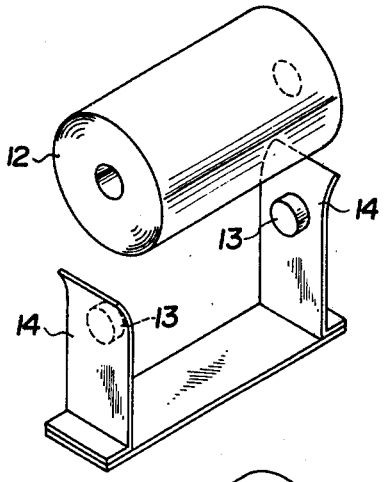
FIG. 2 PRIOR ART
FIG. 2 is a perspective view illustrating another example of a conventional paper roll loading device.
Figure 3:
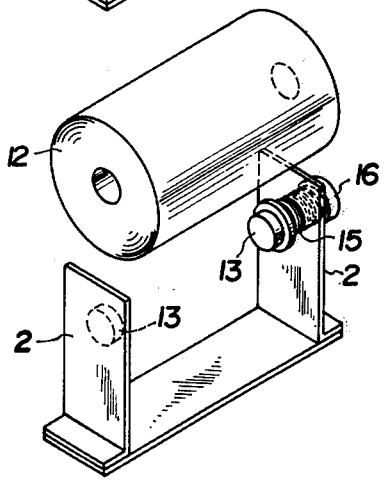
FIG. 3 PRIOR ART
FIG. 3 is a perspective view illustrating a further example of a conventional paper roll loading device.
Figure 4:
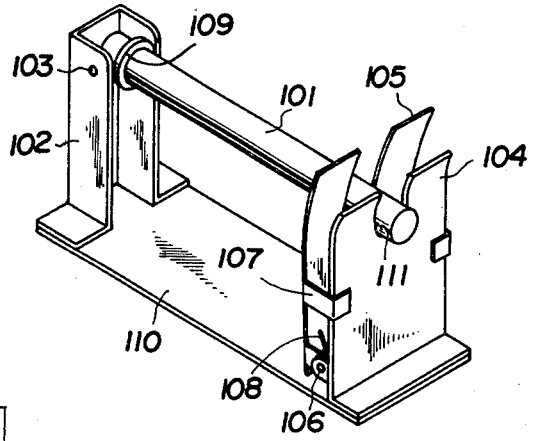
FIG. 4 is a perspective view illustrating an exemplary embodiment of paper loading device according to the present invention.
Figure 5:
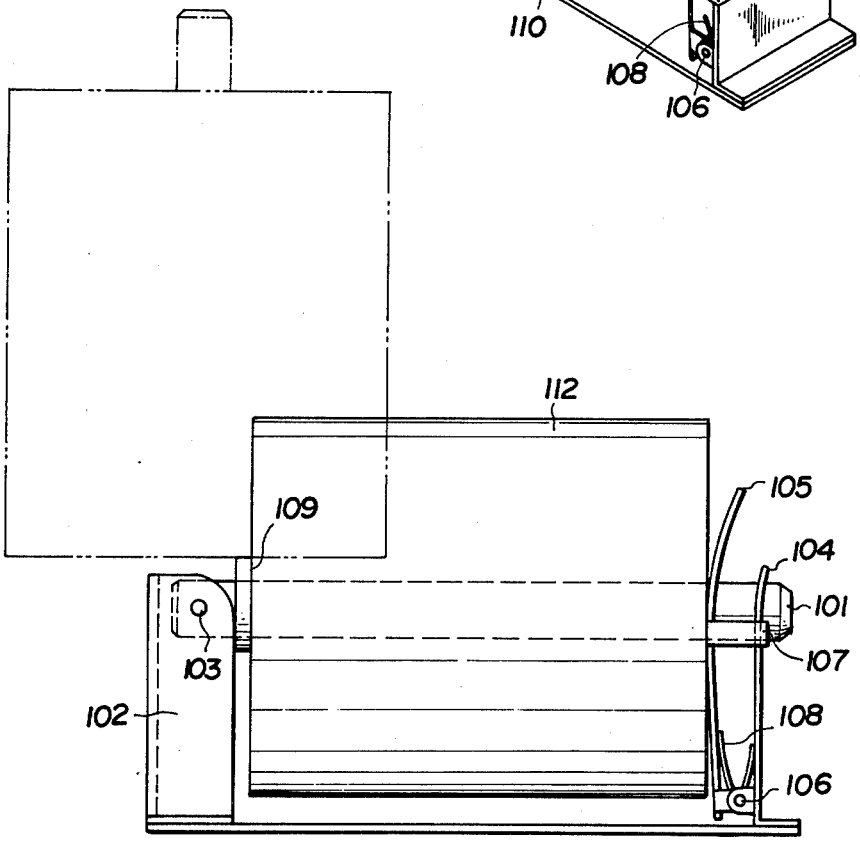
FIG. 5 is a side view of the paper roll loading device of FIG. 4, to which a recording paper roll is loaded.

Referring to FIGS. 4 and 5, indicated as 101 is a center shaft to be fitted into the center hole of paper roll. The center shaft 101 has a length longer than the width of the paper roll. One end of the shaft 101 is supported rotatably by a pivot 103 disposed in a stationary support member 102 (hereinafter referred to as a first support member). Means, preferably a stationary plate 104 having a U-shaped notch 111, is provided opposite to the support member 102 for supporting the other end portion of the center shaft 101. This supporting means is hereinafter referred to as a second support member.

For loading the paper roll in this device, first the center shaft 101 is rotated manually to its rise position, at an angle sufficient to permit the insertion of the shaft 101 into the center hole of paper roll. After fitting the paper roll (as shown by the two-dot chain line in FIG. 5), the shaft 101 is rotated back to its service position where the free end of the shaft 101 engages with the notch 111 (as shown in the solid line in FIG. 5).

In order to place the paper roll at a predetermined position, an urging means 105 such as a side pressure plate, is preferably provided for pressing the end face of the paper roll in a direction toward the support member 102. In this case, it is preferred that the center shaft 101 have a flange 109. The side pressure plate is hinged to the second support member 104 in the manner to be rotatable around a hinge pin 106, to which a compressing member 108 such as a coil spring, a leaf spring etc. is connected. Although the side pressure plate 105 is so energized as to rotate inward, it is brought to a stop after predetermined rotation by means of a stopper 107 to limit the rotation, thereby the rotation of the center shaft 101, fitted with the paper roll, from the rise position to the service position may be done without receiving the hindrance from the pressure plate 105. The side pressure plate 105 also has a U-shaped notch which serves to provide an escapement for the rise of the center shaft. Thus, when the center shaft 101 fitted with the paper roll is rotated toward the service position, the side pressure plate 105 is rotated outward while being pushed away by the circumferential end of paper roll, thereby compressing the coil spring 108. As the center shaft 101 is further rotated downward, it comes to butt against the bottom of the U-shaped notch 111 of the second support member 104, hence being stopped there. In this state, due to the action of the coil spring 108, the side pressure plate 105 is pressed against the end face of paper roll 112, which is thereby pressed against the flange surface 109 of center shaft 101 and is brought to a stop at the predetermined position. The lateral pressure exerted on the end face of the paper roll by the side pressure plate 105 also serves to prevent the looseing of the roll during use in addition to displacing the paper to the predetermined position.

Figure 6:
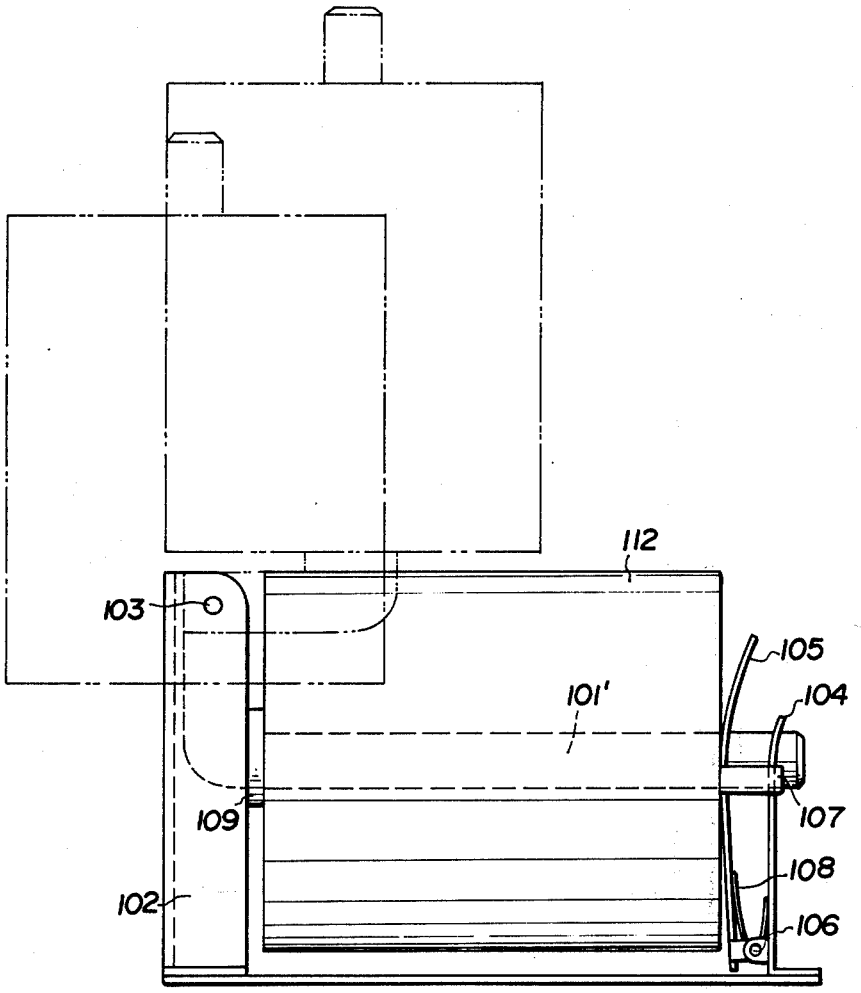
FIG. 6 is a side view showing a modification of the loading device of the present invention.

For the reason that the center shaft 101 is shaped to be linear in the above-described device, the paper roll partially overhangs the upper space of the stationary support member 102 in the state where the center shaft 101 is at its rise position, as shown by the two-dot chain line in FIG. 5, so that interference takes place if any other component exists in the said space. To cope with this problem, as illustrated in FIG. 6, it is advantageous that the center shaft be formed into a L-shape so as to have a bent portion at the end of which the shaft is rotatably supported. As a consequence of this L-shaped design, more sufficient space is ensured in the vicinity of the first support member 102, as is apparent from FIG. 6, wherein the upper part indicates a rise position of the modified center shaft having a bent portion while the lower part indicates a rise position of the center shaft shown in FIG. 5.

Although in the foregoing embodiment the side pressure plate 105 and the bottom of the second support member 104 are coupled to each other by the use of a hinge 106, the coupling means is not always limited to a hinge alone. However, hinge coupling is preferred on the grounds of simplifying the structure and facilitating the rotation of the slide pressure plate.

Moreover, the device of this invention may be so modified as to interpose a friction member between the first support member 102 and the center shaft 101 for impeding free rotation of the shaft after its displacement to the rise position. Instead of the U-shaped notch 111, other means such as magnet member may be used for holding the center shaft 101. A stopper or click may be suitably provided in the first support member 102 for keeping the raised center shaft 101 at a fixed position. Further, the loading device may so modified as to interlock the center shaft 101 with an openable/closable cover of the machine in such a manner that the center shaft 101 rises in relation to opening of the cover.

According to the paper roll loading device of the present invention, it becomes possible to accomplish easy loading of the paper roll with rotation of the center shaft and also to attain immediate alignment of the center line. And furthermore, the paper roll is settable normally at a predetermined position when pressed against the flange surface of the center shaft by the spring of the side pressure plate, so that winding of the paper roll is preventable during use due to such pressure.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for loading a paper roll, comprising:

a first support member;

a center shaft adapted to be fitted into the center hole of the paper roll, one end of said center shaft being pivotally supported with the first support member;

a second support member having a part for holding the other end of the center shaft;

pressure means having a face able to contact with one side of the paper roll;

spring means for urging said pressure means in the direction toward the first support member around at least one fulcrum;

at least one stopper means for limiting the movement of said pressure means which is urged by said spring means in the direction toward the first support member.

2. A device as claimed in claim 1, wherein said pressure means is rotatable around the lower end of said second support member as a fulcrum and said stopper means is provided at a portion of said second support member.

3. A device as claimed in claim 1, wherein said second support member is a stationary plate having a notch adapted to engage with said the other end of said center shaft.

4. A device as claimed in claim 1, wherein said center shaft has a bent portion at the end of which said center shaft is pivotally supported with said first support member.

5. A device as claimed in claim 1, wherein said center shaft has a flange arranged such that the end face of said paper roll is pressed against the surface of said flange by the action of said urging means.

* * * * *